US009932826B2

(12) United States Patent
Krings et al.

(10) Patent No.: US 9,932,826 B2
(45) Date of Patent: Apr. 3, 2018

(54) MOBILE MINING

(71) Applicant: CATERPILLAR GLOBAL MINING EUROPE GMBH, Lünen (DE)

(72) Inventors: Johannes Krings, Dortmund (DE); Joachim Raschka, Bochum (DE); Jan Rohwer, Dortmund (DE); Oliver Kortmann, Werne (DE); Ulrich Bechem, Hagen (DE); Christian Schreiter, Venusberg (DE); Jens Steinberg, Lünen (DE)

(73) Assignee: Caterpillar Global Mining Europe GmbH, Lünen (DE)

( * ) Notice: Subject to any disclaimer, the term of this patent is extended or adjusted under 35 U.S.C. 154(b) by 0 days.

(21) Appl. No.: 14/421,981

(22) PCT Filed: Aug. 13, 2013

(86) PCT No.: PCT/EP2013/002430

§ 371 (c)(1),
(2) Date: Feb. 16, 2015

(87) PCT Pub. No.: WO2014/026761

PCT Pub. Date: Feb. 20, 2014

(65) Prior Publication Data

US 2015/0204190 A1 Jul. 23, 2015

(30) Foreign Application Priority Data

Aug. 15, 2012 (DE) ..... 10 2012 107 485

(51) Int. Cl.
*E21C 27/24* (2006.01)
*E21C 25/08* (2006.01)
(Continued)

(52) U.S. Cl.
CPC ..... *E21C 25/08* (2013.01); *E21C 25/10* (2013.01); *E21C 27/24* (2013.01); *E21C 31/02* (2013.01); *E21D 9/1026* (2013.01)

(58) Field of Classification Search
CPC ..... E21D 9/102; E21D 9/1029; E21D 9/1086
See application file for complete search history.

(56) References Cited

U.S. PATENT DOCUMENTS 4,169,629 A * 10/1979 Legrand ..... E21D 9/1093 299/31
4,317,594 A 3/1982 Ünger et al.
(Continued)

FOREIGN PATENT DOCUMENTS

CA 1 145 779 A1 5/1983
CN 101021150 8/2007
(Continued)

OTHER PUBLICATIONS

International Search Report dated Jun. 27, 2014 from Application No. PCT/EP2013/002430.

*Primary Examiner* — John J Kreck

(57) ABSTRACT

The present disclosure relates to a mobile mining machine which may comprise a movable machine base frame, a rotatable tool drum and including excavating tools. The mobile mining machine may further comprise a cantilever unit including a front support arm part and a base part, and a pivotal device to pivot the cantilever unit. The mobile mining machine may further comprise a tilt device to tilt the cantilever unit and a rotary mechanism to rotate the support arm part and the tool drum. Thus, a mobile mining machine with which tunnels, galleries or shafts may be continuously driven in even in hard rock with a high mining output and low tool wear may be provided.

4 Claims, 7 Drawing Sheets

(51) Int. Cl.

| | |
|---|---|
| ***E21D 9/10*** | (2006.01) |
| ***E21C 25/10*** | (2006.01) |
| ***E21C 31/02*** | (2006.01) |

(56) References Cited

U.S. PATENT DOCUMENTS

| | | | | |
|---|---|---|---|---|
| 4,548,442 | A | 10/1985 | Sugden et al. | |
| 4,645,266 | A * | 2/1987 | Paurat | E21D 9/1026 299/18 |
| 4,662,684 | A * | 5/1987 | Marten | B28D 1/045 299/1.5 |
| 4,721,340 | A * | 1/1988 | Wrulich | E21D 9/1026 299/1.4 |
| 4,838,615 | A | 6/1989 | Oldham | |
| 5,192,116 | A | 3/1993 | Turner et al. | |
| 5,234,257 | A | 8/1993 | Sugden et al. | |
| 5,536,073 | A * | 7/1996 | Sulosky | B28D 1/186 299/106 |
| 6,244,665 | B1 * | 6/2001 | Bise | E21C 35/18 299/106 |
| 7,182,407 | B1 | 2/2007 | Peach et al. | |
| 7,631,942 | B2 | 12/2009 | Bechem et al. | |
| 7,896,445 | B2 * | 3/2011 | Bechem | E21C 27/22 299/71 |
| 2010/0001574 | A1 | 1/2010 | Bechem | |

FOREIGN PATENT DOCUMENTS

| | | | | |
|---|---|---|---|---|
| CN | 101512101 | | 8/2009 | |
| CN | 201460884 | | 5/2010 | |
| CN | 102305066 | | 1/2012 | |
| CN | 103046927 | | 4/2013 | |
| CN | 204238931 | | 4/2015 | |
| DE | 2447604 | | 4/1976 | |
| DE | 2447604 | A1 * | 4/1976 | |
| DE | 2723675 | A1 | 11/1978 | |
| GB | 1494762 | | 12/1977 | |
| JP | 2634655 | B2 * | 7/1997 | E21D 9/102 |
| WO | 2008025555 | | 3/2008 | |
| WO | 2010/050872 | A1 | 5/2010 | |
| WO | 2012156841 | | 11/2012 | |
| WO | 2012156843 | | 11/2012 | |
| WO | 2012156884 | | 11/2012 | |
| WO | WO 2015099633 | A1 * | 7/2015 | E21C 27/24 |

* cited by examiner

MOBILE MINING

CROSS-REFERENCE TO RELATED APPLICATIONS

This application is a National Stage of International Patent Application No. PCT/EP2013/002430, filed Aug. 13, 2013, which claims priority to foreign German Patent Application No. 10 2012 107 485.2, filed Aug. 15, 2012, the contents of which are incorporated herein by reference in their entirety.

TECHNICAL FIELD

The present disclosure relates to a mobile mining machine, and more particularly to a mobile mining machine for driving tunnels, galleries or shafts into hard rock and the like.

BACKGROUND

In tunnel mining, movable (mobile) mining machines have long been known with which a tunnel shaft can be driven forwards particularly also in hard rock. Corresponding tunnel boring machines, which have at the front side of a machine frame a cutting wheel as the tool drum with cutting discs arranged around the periphery of the cutting wheel are known, for example, from U.S. Pat. No. 4,548,442 or U.S. Pat. No. 5,234,257.

The present disclosure is based on a mining machine as well as a method according to WO 2010/050 872 A1. The corresponding machine is provided both for driving in tunnels and also in general for mining excavation, and works like the other known tunnel boring machines with a tool drum rotating about a drum axis and having on its periphery a number of radially outwardly directed spread-out excavating tools in the form of cutting discs. By means of a cantilever arm fitted at its front end with the tool drum, and a pivotal device, with which the cantilever arm can be pivoted relative to the movable machine base frame, the material is cut away at the work front or at the head face in front of the cutting head by pivoting the cutting head to and fro. With the mobile mining machine known from WO 2010/050 872 A1, the cutting discs can freely rotate in their suspension. The cutting discs are arranged spread out over the periphery of the tool drum so that the rotational axes of some of the cutting discs are parallel to the rotational axis of the tool drum and the rotational axes of other cutting discs stand inclined to the rotational axis of the tool drum. Through the spread-out arrangement of a number of cutting discs, with each pivotal movement with each cutting disc material is to be cut out only partially. Hereby, the load on the individual cutting discs, and, thus, the wear on the excavating tools on the cutting wheel is kept down. The pivotal axis for the pivotal movement stands substantially perpendicular at least to the drive chassis of the machine base frame. The cantilever arm can be raised or lowered via a tilt cylinder in order to break down material with the cutting wheel at different heights or banks. According to one embodiment, the pivotal movement of the tool drum takes place along an arc face, which is formed at the front end of the cantilever arm. Furthermore, a configuration of a mining machine is disclosed in WO 2010/050 872 A1 wherein two or three cutting wheels are provided. These cutting wheels can then each be pivoted inwards and outwards about a pivotal bearing relative to the machine base frame. The individual cutting wheels are thereby to be suspended from a frame, which can be turned about the tunnel longitudinal axis in order, by rotating the frame which holds the numerous cutting wheels, to be able to drive a tunnel in and forward with the oppositely movable cutting wheels, which themselves can only be pivoted perpendicular to the rotational axis of the tool drum.

In addition to driving in tunnels with in principle passively operating cutting discs, from US 2010/0001574 A1 or U.S. Pat. No. 7,631,942 B2 of the applicant, milling or drilling mining machines are also known having self-rotating excavating tools, which are mounted on a rotatable drum. The actual excavating tools on those mining machines consist of individual chisel tips which rotate with mostly high rotational speed about the rotational axis of a tool holder wherein the tool holder is fitted with several tool chisels. By rotation of the tool drum, only individual chisels of one tool holder have short term contact at the same time with the rock, which is to be excavated. Since with these mining machines only some few chisel tips or only one single chisel tip is/are in contact with the rock, which is to be excavated, a relatively low contact pressure force is necessary although a high excavating force can still be achieved.

The object of the present disclosure is to provide a mobile mining machine with which tunnels, galleries or shafts can be driven in or advanced even in hard rock with a high mining output and low tool wear.

Moreover, the present disclosure is directed, at least in part, to improving or overcoming one or more aspects of prior systems.

SUMMARY OF THE DISCLOSURE

According to one aspect of the present disclosure, a mobile mining machine may comprise a movable machine base frame and a tool drum rotatable about a drum axis. The tool drum may include excavating tools arranged around the periphery of the tool drum. The mobile mining machine may further comprise a rotational drive to drive the tool drum, and a cantilever unit including a base part and a front support arm part on which the tool drum is rotatably mounted. The mobile mining machine may further comprise a pivotal device to pivot the cantilever unit relative to the machine base frame, a tilt device to tilt the cantilever unit, and a rotary mechanism. The rotary mechanism may be mounted between the support arm part and the base part to rotate the support arm part and the tool drum relative to the base part about a longitudinal axis of the cantilever unit.

In another aspect of the present disclosure, a method for driving tunnels, galleries or shafts into hard rock or the like may comprise providing a mobile mining machine as exemplary disclosed herein, and pivoting the cantilever unit about the pivotal axis. The method may further comprise excavating material at a work face with the rotating tool drum during the pivotal process in both pivotal directions, and rotating the drum axis of the tool drum between each pivotal process via the rotary mechanism during excavation of material the work face, whereby material is continuously excavated with the excavating tools.

Other features and aspects of this disclosure will be apparent from the following description and the accompanying drawings.

BRIEF DESCRIPTION OF THE DRAWINGS

Advantages and configurations of a mining machine according to the present disclosure as well as the method to be carried out herewith for excavating material are apparent from the following description of one embodiment illustrated diagrammatically in the drawing. In the drawings.

DETAILED DESCRIPTION

Figure 1:
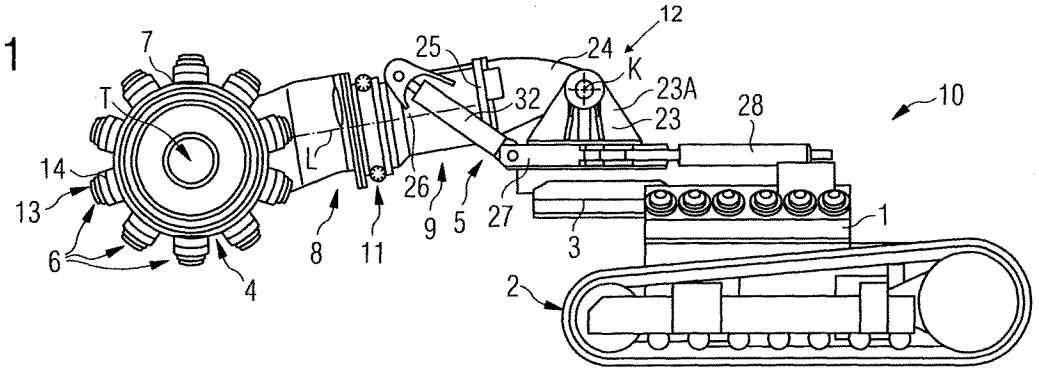
FIG. 1 shows diagrammatically simplified in a side view a mobile mining machine according to the present disclosure.

The following is a detailed description of exemplary embodiments of the present disclosure. The exemplary embodiments described therein and illustrated in the drawings are intended to teach the principles of the present disclosure, enabling those of ordinary skill in the art to implement and use the present disclosure in many different environments and for many different applications. Therefore, the exemplary embodiments are not intended to be, and should not be considered as, a limiting description of the scope of patent protection. Rather, the scope of patent protection shall be defined by the appended claims.

According to the present disclosure, it is proposed that the cantilever unit may have a front support arm part on which the tool drum is mounted on one side, and a base part. Between the support arm part and the base part there is a rotary mechanism for turning the support arm part and, hereby, also the tool drum or drum axis relative to the base part about a longitudinal axis of the cantilever unit. Through the rotary mechanism which is present between the support arm part on one side and the base part on the other, it may be possible, in the case of a one-sided mounted tool drum, to guide the tool drum permanently so that the drum axis always points in the direction of movement of the cantilever unit. Hereby, individual tool chisels of the excavating tools can be continuously in material engagement with the mining work front.

Figure 2:
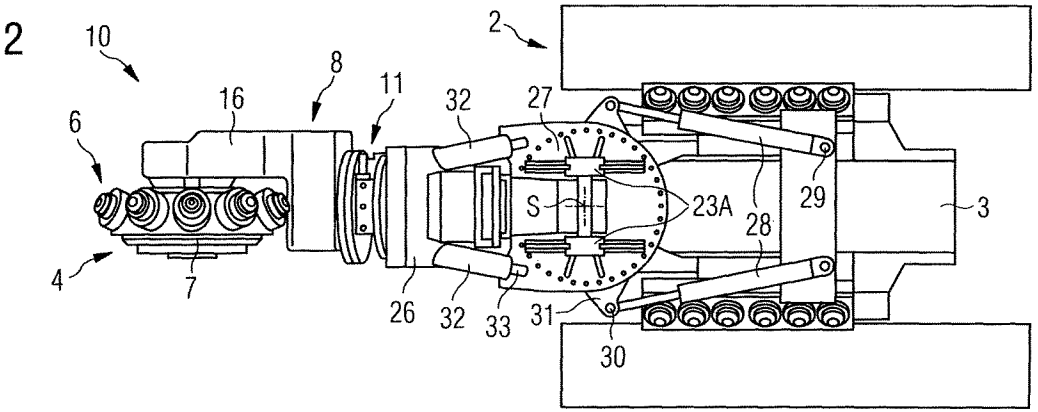
FIG. 2 shows a plan view of the mining machine according to FIG. 1.

In FIGS. 1 and 2, a mobile mining machine according to the present disclosure is marked overall by 10 and has a machine base frame 1 of any shape which can be driven (moved) by means of a drive chassis 2, by way of example a caterpillar tractor, in a tunnel, but also in an underground gallery or the like. The machine base frame 1 is here only illustrated diagrammatically for symbolization of a mobile mining machine 10 and can be provided with diverse driving devices, where applicable a conveyor belt for discharging the excavated material, a driver cab and further devices. On the machine base frame 1, a slide carriage unit 3 is in the illustrated embodiment guided longitudinally displaceable so that a tool drum 4 can also be displaced via a movement of the slide carriage unit 3, also without movement of the drive chassis 2 forwards or backwards until the displacement path of the slide carriage unit 3 is exhausted. The tool drum 4 is connected to the slide carriage unit 3 via a cantilever unit 5. In the illustrated embodiment the entire cantilever unit 5 is supported next to the tool drum 4 via the slide carriage unit 3 on the machine base frame 1. The tool drum 4 is rotatable about a drum axis T, which is only indicated, and the tool drum 4 has excavating tools marked overall with reference numeral 6 and arranged angularly off-set relative to one another on the drum periphery of the drum housing 7, wherein each excavating tool 6, as will be explained below, comprises a rotatable tool holder 13 with a support head 14 located outside of the drum housing 7.

The tool drum 4 is mounted on one side on a support arm part 8. The support arm part 8 forms a quasi-single arm rocker for the one-sided rotatable support of the tool drum 4. The support arm part 8 in turn forms together with a base part 9 the cantilever unit 5, wherein between the support arm part 8 on the one hand and the base part 9 on the other, according to the present disclosure, there is an interposed rotary mechanism 11 with which the support arm part 8, and thus also the drum axis T of the tool drum 4, can be pivoted relative to the base part 9 about a longitudinal axis L (indicated in FIG. 1) of the cantilever unit 5. The cantilever unit 5 in turn can be tilted about a tilt axis K by means of a tilt device 12, and can be pivoted by means of pivotal cylinders about a pivotal axis S, indicated as a cross in FIG. 2, as will be explained below.

Figure 4:
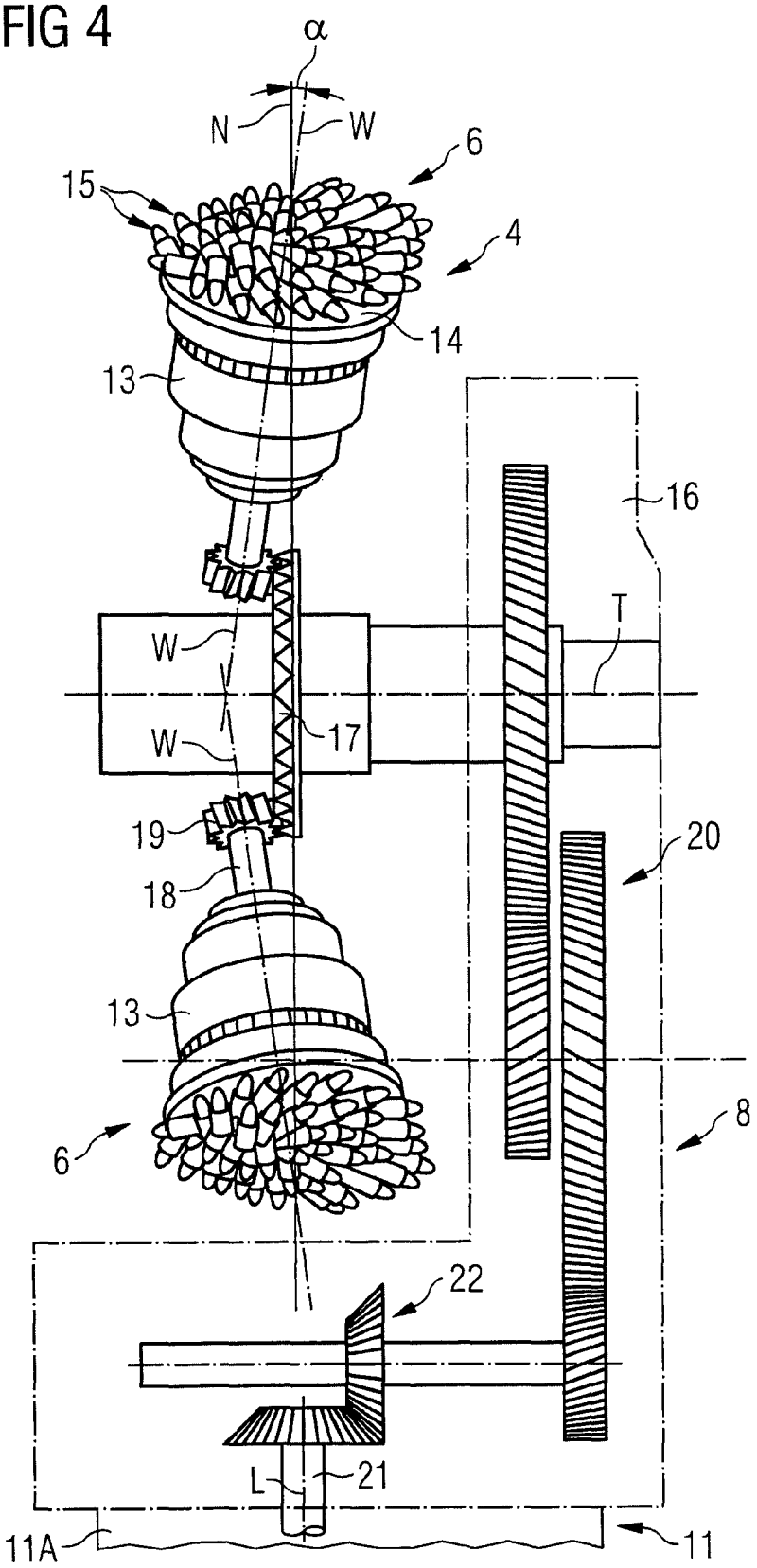
FIG. 4 shows diagrammatically greatly simplified the construction of the support arm part and the tool drum with inclined rotatable tool holders.

The structure of the tool drum as well as of the support arm part 8 designed as a single arm rocker will be explained now initially with reference to the diagrammatic illustration in FIG. 4. In FIG. 4, the tool drum 4 is illustrated without a drum housing and, of the ten excavating tools 6 arranged spread out over the periphery, only two excavating tools 6 are shown which are arranged off-set relative to one another by 180°. Each excavating tool comprises a tool holder 13 with a support head 14, which is located outside of the drum housing (not shown) of the tool drum and which is fitted with a number of tool chisels 15. The tool holders 13 are drivable in rotation, wherein their shaft axes W run substantially transversely to the drum axis T of the tool drum 4. The arrangement is thereby designed so that the shaft axes W of the tool holders 13 are aligned relative to the radial direction or normal N to the drum axis T of the tool drum 4 at an angle $\alpha$ of about 15° to the rocker arm 16 of the support arm part 8. This inclined position of the shaft axis W ensures with material excavation where the tool drum 4 is preferably moved in the axial direction of the drum axis T by means of the tilt device and/or pivotal mechanism, that a free angle is reached and only individual tool chisels 15 remove material at a work face whilst the other tool chisels rotate without material contact until they are located in the material excavating position again as a result of the rotation of the tool holders 13.

It can further be seen from FIG. 4 that the tool holders 13 inside the tool drum 4 are provided with a common drive to which a crown gear wheel 17 belongs, which is mounted concentric with the drum axis T and is mounted stationary on the drum axis T. Each tool holder 13 is provided with its own drive shaft 18, which supports on its radially inwardly lying end remote from the support head 14, a bevel wheel gear 19, which meshes with the teeth on the crown gear wheel 17. The complete common drive is housed inside the drum housing (not shown in FIG. 4) of the tool drum 4 and is hereby protected from dust, damp etc. The rotating drive of the tool drum 4 is provided via a reduction gearing 20 which is mounted inside the rocker arm 16 of the support arm part 8 and in turn protected from dust and damp, for which the complete support arm part 8 is made hollow. When the tool drum 4 is set in rotation by means of the gearing 20 it leads to a relative rotation of the tool drum 4 relative to the crown gear wheel 17, which is mounted fixed on the drum axis in the interior chamber. The tool holders 13, which are mounted rotatable on the periphery of the tool drum 4, are set in rotation by the rigid crown gear wheel 17 via the bevel gear wheels 19. The speed ratio between the speed of the tool drum 4 and the speed of the tool holders 13 is thereby constant and can be determined by the translation of the bevel gear wheel stages 17, 19, and can be by way of example 10:1.

The external drive of the tool drum 4 in turn takes place by means of a rotational drive (26, FIG. 1), which is mounted in the base part (9, FIG. 1) of the cantilever unit 5, and of which only the output shaft 21 is illustrated in FIG. 4. The rotation of the output shaft 21 is transferred into the transmission gearing 20 via a further gearing 22 here indicated only in diagrammatically simplified form. The output shaft 21 of the rotational drive lies centrally relative to the longitudinal axis L of the cantilever unit and passes centrally through the support arm side section 11A (only outlined in FIG. 4) of the rotary mechanism 11, wherefore the support arm part 8 in principle can be turned in any way, at least, however, about 180° into the one and into the other direction about the longitudinal axis L, so that the drum axis T can always point in the direction of movement of the cantilever unit and the side of the tool drum 4 lying remote from the rocker arm 16 lies always at the front in relation to the direction of movement of the cantilever unit. The direction of movement depends on that direction in which the support arm part 8 is moved by means of the pivotal device or the tilt device.

Reference is now made to FIGS. 1 and 2. The cantilever unit 5 is fastened so that it can tilt about the tilt axis K on a tilt console 23, which comprises two console arms 23A either side of the base part 9 of the cantilever unit 5. The base part 9 is hereby divided into a tilt foot 24 with a pivotal socket in the rear region and a stop flange 25 in the front region, wherein a suitable rotational drive 26 is screwed replaceable on this stop flange 25, wherein its output shaft, as explained further above, engages centrally through the rotary mechanism 11 into the support arm part 8. The two console arms 23A of the tilt console 23 are mounted on a pivotal base 27, which can be pivoted about a pivotal axis S, which runs perpendicular to the slide carriage unit 3. For pivoting the pivotal base 27 relative to the slide carriage unit 3, there are two pivotal cylinders 28, which are attached by their rear cylinder stops 29 on the slide carriage unit 3, and which stop by their front cylinder stops 30 against lateral extensions 31 on the pivotal base 27. The distance between the front cylinder stops 30 is greater than the distance between the rear cylinder stops 29 on the slide carriage unit 3. The tilt device 12 in turn comprises two tilt cylinders 32 which are attached by their one end 33 in the front region of the pivotal base 27 and by their other ends close to the rotary mechanism 11 on the housing of the rotational drive 26.

In some embodiments, the tool drum 4 defines a preferred cutting direction S which may be substantially parallel to the tool drum axis T of the tool drum 4 and/or substantially perpendicular to the longitudinal axis L of the cantilever unit 5.

INDUSTRIAL APPLICABILITY

Figure 3:
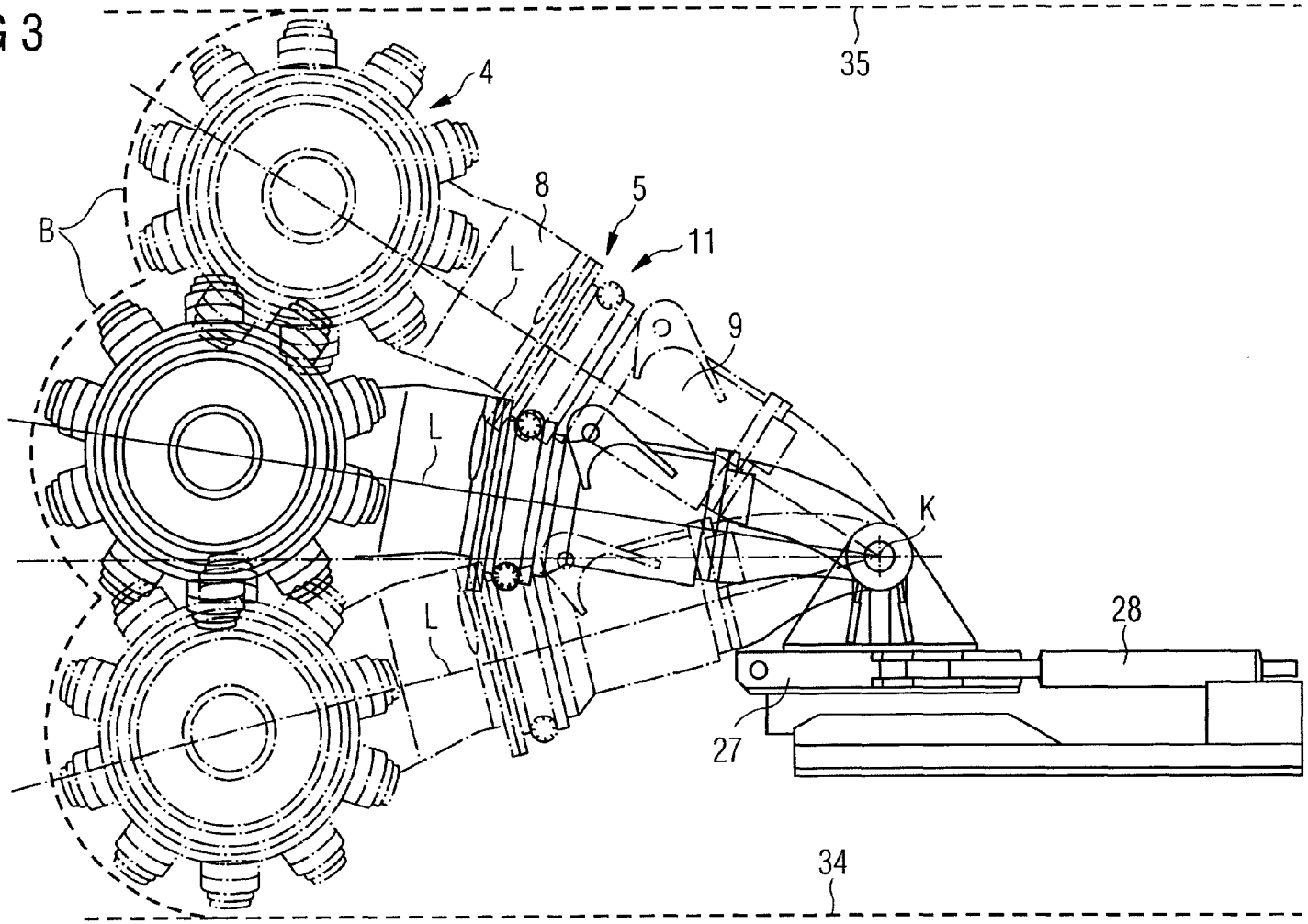
FIG. 3 shows diagrammatically simplified the tool drum in three different tilt positions of the cantilever unit for the material excavation in different height surface tracks.

The procedure for excavating material with the mobile mining machine 10 will now be explained with reference in particular to FIGS. 3 and 5A-5L. FIG. 3 shows the cantilever unit 5 next to the tool drum 4 in three different tilted positions for excavating material in three different surface tracks, namely a lowermost surface track, a middle surface track, and an uppermost surface track. The excavating cross-section between the bed 34 and the roof 35 of a tunnel, which is set at the head face B, is indicated in FIG. 3. The longitudinal axis L when excavating the middle cutting or surface track is pivoted upwards by approximately 9° relative to the horizontal. The effective drum diameter, which is determined by the distance of the radially outermost tool chisel on the tool drum 4, is in the illustrated embodiment greater than the distance of the tilt axis K from the bed 34. The material excavations with the middle surface track and the lower surface track in which the longitudinal axis L lies vertically pivoted downwards accordingly in relation to the horizontal, lie approximately one above the other, whilst the material excavation in the uppermost surface track, as can be clearly seen from FIG. 3, lies clearly off-set backwards relative to those. The individual surface tracks are excavated by a purely pivotal process of the pivotal base 27 for which the pivotal cylinders are driven in or out accordingly as drive members. As soon as the tool drum 4, however, passes into the vicinity of the lateral tunnel stacks, the rotary mechanism 11 is actuated between the base part 9 and the support arm part 8 in order to move the tool drum 4 into the next higher or next lower surface track whilst maintaining the material excavation. For this, the tilt cylinders 32 are also driven in or out simultaneously. Since through a suitable actuation of the rotary mechanism 11 the tool drum 4 always runs past the support arm part 8 during material excavation, the support arm part is located each time in the shadow of the tool drum 4 and the drum axis always lies parallel to the direction of movement of the cantilever unit 5.

Figure 5A:
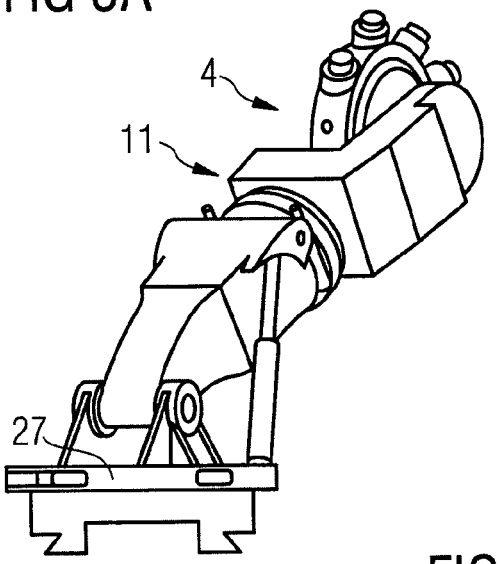
FIGS. 5A-5L show, using individual images, the procedural sequence when excavating material with the excavation machine according to the present disclosure.
Figure 5B:
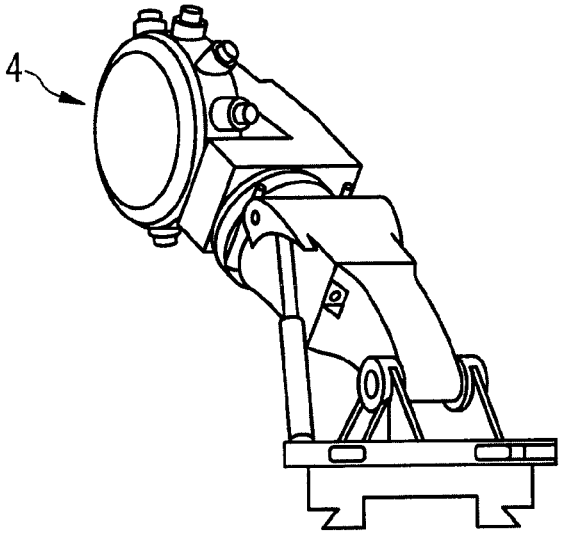
Figure 5C:
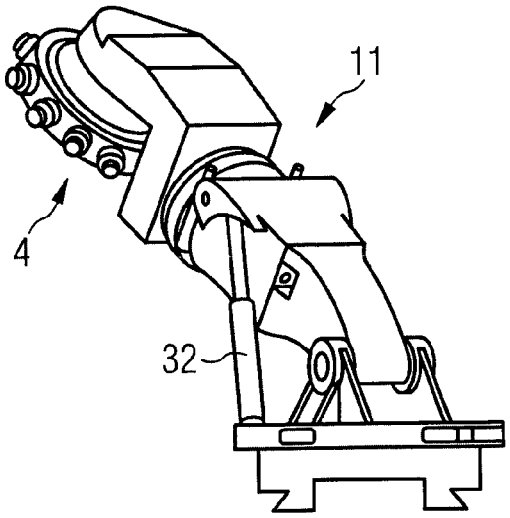
Figure 5D:
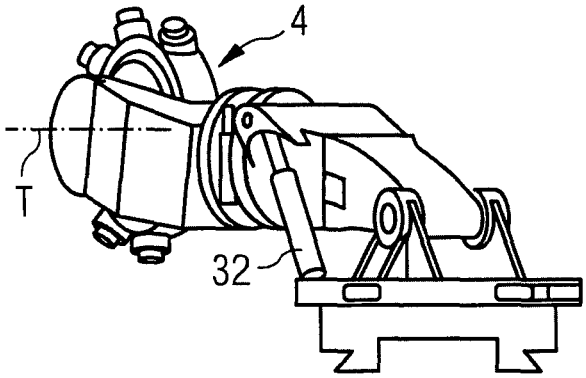
Figure 5E:
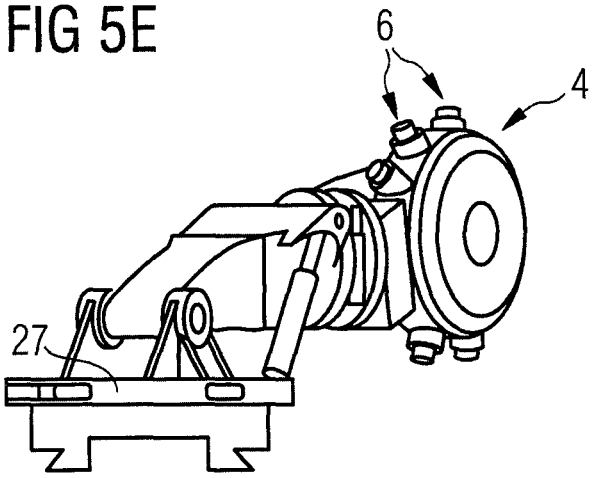
Figure 5F:
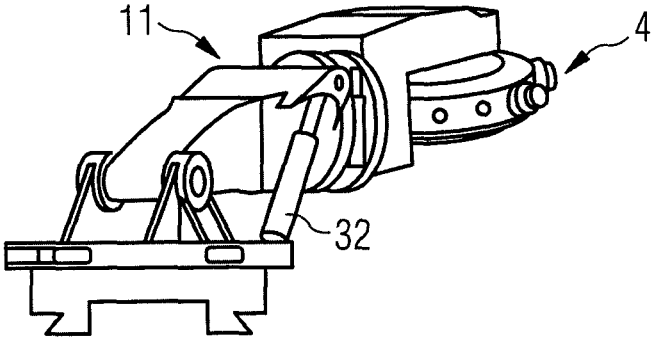
Figure 5G:
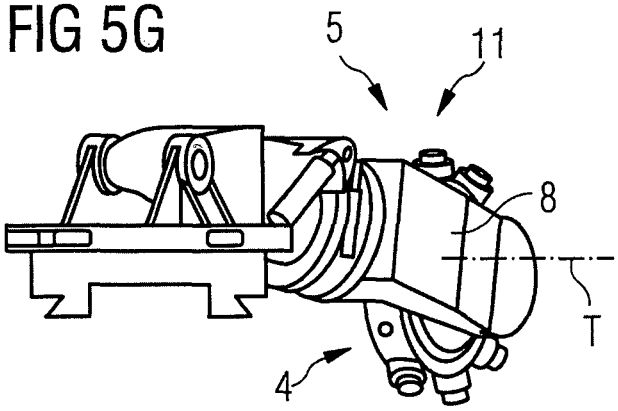
Figure 5H:
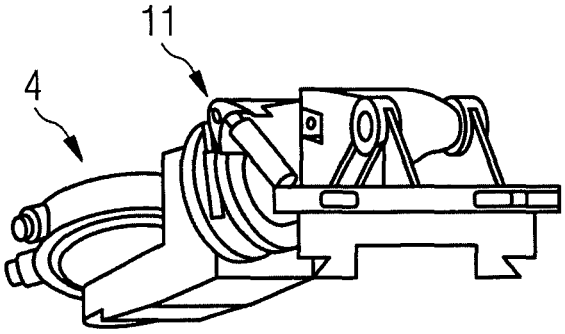
Figure 5I:
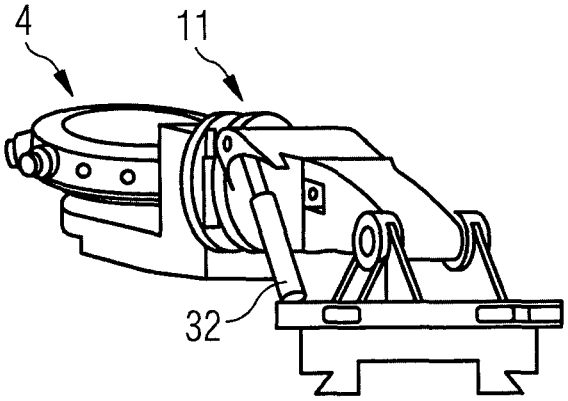
Figure 5J:
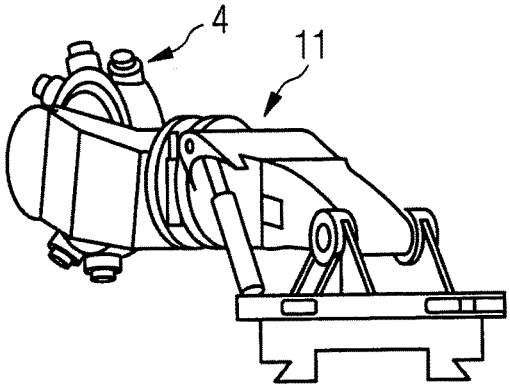
Figure 5K:
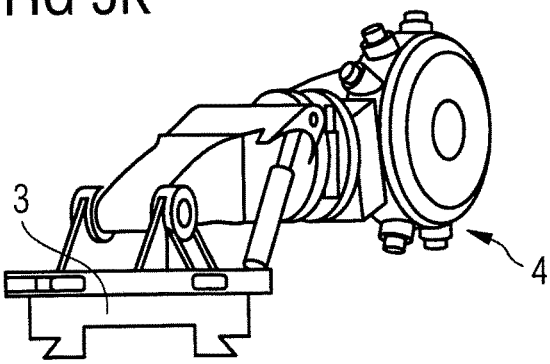
Figure 5L:
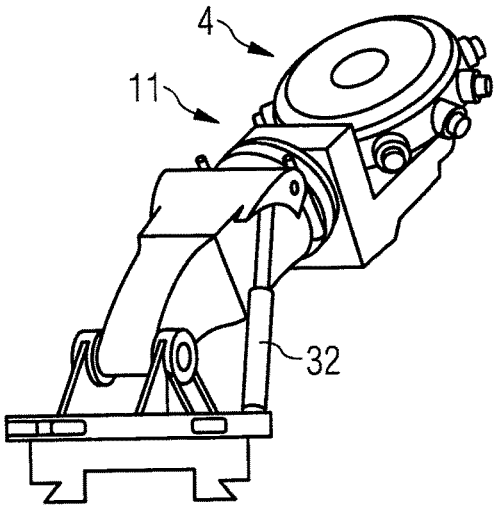

The excavating cycle, which can be actuated with the mobile mining machine 10 comprising a rotary mechanism 11, is shown progressively again in FIGS. 5A to 5L. In FIG. 5A, the excavating process starts on the right stack side in the uppermost surface track. By pivoting the pivotal base 27, the tool drum 4 is moved to the left stack side of the tunnel (FIG. 5B) and then, with continuous material excavation and through simultaneous actuation of the rotary mechanism 11 and the tilt cylinders 32 of the tilt device (FIG. 5C), the tool drum 4 is lowered to the level of the middle surface track, wherein the tool drum is turned round 180° until the drum axis T of the tool drum 4 lies substantially horizontally aligned again (FIG. 5D). Then, through renewed actuation of the pivotal device 27 and without actuation of the tilt device and rotary mechanism with the rotating excavating tools 6 on the rotating tool drum 4, the middle surface track is excavated from the left to the right stack side of the tunnel (FIG. 5E). On reaching the right tunnel stack for the second time, the tool drum 4 is again moved by simultaneous actuation of the rotary mechanism 11 and tilt cylinder 32 (FIG. 5F) into the lowermost surface track and, at the same time, a return rotation takes place about 180° in this same alignment of the tool drum 4 and drum axis T (FIG. 5G) as before excavation of the uppermost surface track, wherefore the tool drum 4 runs forward past the support arm part 8 furthermore in the direction of movement of the cantilever unit 5. With the aid of the pivotal device, the lowermost surface track is then excavated in a substantially horizontally running pivotal process. Then, through simultaneous actuation of the rotary mechanism 11 and tilt cylinder 32, the tool drum 4 is moved back again into the middle surface track (FIG. 5H, FIG. 5I), wherein the rotary mechanism 11 is turned further about 180° in relation to the last rotation into this same rotational direction, until the end position according to FIG. 5J is reached. During the next pivotal process with the rotating tool drum 4 in the middle surface track, a cutting depth adjustment of the tool drum 4 takes place in the mining direction by actuation of either the slide carriage unit 3 (FIG. 5K) or of the drive chassis, and on reaching the right tunnel stack for a third time, the tool drum 4 is then, by rotating back the rotary mechanism 11 and actuating the tilt device or tilt cylinder 32 (FIG. 5L), returned to the starting position (FIG. 5A) at the beginning of the uppermost surface track. An excavating process can then start with the previously set new cutting depth n of the uppermost surface track. The entire excavating process takes place continuously, however, without any interruption and without any idle travelling or idle stroke of the tool drum, which in each case is turned by means of the rotary mechanism first about 180° in the one rotational direction, then rotated back, then rotated further about 180° in the same rotational direction and then turned back again, whilst during excavation of the surface tracks only the pivotal device is actuated.

For the person skilled in the art numerous modifications are apparent from the preceding description which are to fall within the field of protection of the claims. All the illustrations of the gearing and also the arrangement of the tool chisels etc. serve solely for explaining the structure of the mining machine. As rotary mechanism can be used various different constructions which enable a sufficient pivoting of two relatively powerful connecting flanges relative to one another. The rotary mechanism can be driven by way of example by worm gears wherein two interconnected pivot rings, of which one is connected to the support arm part and the other is connected to the base part or rotational drive, are pivoted relative to one another. As a rule, it is sufficient if the rotary mechanism permits pivoting of the drum axis about 180° in both directions, thus overall about 360°. The number of tool holders spread around the periphery and the number of tool chisels on the tool holders can vary and all the processing directions and movement runs can be reversed. Both the tilting about the tilt axis and also the pivoting about the pivotal axis can also be carried out with drive members other than cylinders.

With the mobile mining machine according to the present disclosure, each of the several excavating tools, which are spread out over the periphery, comprises a rotatable tool holder with a support head, which holds several tool chisels each, wherein the rotational axes of the tool holders preferably each run inclined to the drum axis. Through the superimposition of the rotational movement of the tool drum and the rotational movement of the tool holder holding the tool chisels on the periphery of the tool drum, the excavation of the material takes place outside of the periphery of the tool drum and a very short compact impulse-like engagement of the individual processing chisels in the rock to be excavated at the mining front may be achieved. Despite the high excavating force, which may be achieved by means of the excavating tools, only a relatively light contact pressure force of the tool drum may be required against the rock, which is being excavated, whereby the corresponding tool drum may be used with great advantage on a mobile mining machine. Through the preferably provided inclined position of the rotational axes of the tool holders relative to the normal to the drum axis, it may be reached that the individual tool chisels by maintaining a free angle corresponding to the inclined position of the rotational axes move into contact with the material, which is being excavated, only at the work front and can chip out material accordingly at the work front. Several tool chisels are mounted on each tool holder, wherein several tool chisels can not only be mounted peripherally-offset on the same part circle but also can be arranged at different radial distances from the rotational axis of the respective tool holder and from the drum axis. Furthermore with the tool drum it may be possible to excavate a work front or mining face, which may be higher and wider than the effective diameter of the tool drum, which is carrying out the excavating work. Through the rotary mechanism, which is present, material can be continuously worked at the mining work front, for example, in three horizontal surface tracks, namely a topmost, middle and lowermost surface track, wherein a material excavation also takes place continuously by means of the work drum even during the changeover between the middle and the uppermost or lowermost tool track. Since the alignment of the drum axis of the tool drum is changed by means of the rotary mechanism corresponding to the direction of movement of the cantilever unit, a material excavation can also take place during a change in the level in which material is excavated whilst maintaining the same material engagement containers. The tool drum is moved to and fro during the material excavation by means of the pivotal device between the two side stacks of the tunnel or the like, and is moved at the same time by means of the tilt device between the bed and roof of the tunnel which is to be driven forwards. Through the rotary mechanism it may be possible in turn, in relation to a central position in which the drum axis runs horizontal, to achieve a rotation about at least 180° in both directions relative to this starting position, wherefore the excavating tools on the tool drum always lie opposite the material being excavated with the same side at the front and excavate the material accordingly. The support arm part, which may be preferably designed as a single arm rocker, is located during the excavating process always at the back in relation to the direction of movement of the cantilever unit, therefore in the shadow of the tool drum, whereby material can be continuously excavated with the tool chisels during the pivotal movement and tilting movement.

It may be particularly advantageous if the rotational drive for the tool drum is mounted in the base part, particularly if an output shaft of the rotational drive is aligned centrally to the longitudinal axis of the cantilever unit, since then the rotary mechanism need move solely the tool drum and not the necessary rotational drive for the tool drum and it may be equally relatively simply ensured that the tool drum can be driven permanently independently of the rotational position of the rotary mechanism.

It may be particularly advantageous if the support arm part is designed substantially L-shaped and/or is hollow, whereby a gear train may be mounted protected in the inside of the support arm part and used in particular to transfer the rotational movement of the output shaft to a drive gearwheel for the tool drum. As is known in detail from US 2010/0001574 A1 as regards a tool drum with transversely positioned, where applicable also obliquely transversely positioned, tool holders, the rotational drive for the tool drum can equally also be used as rotational drive for the individual tool holders by mounting a fixed gearwheel on the axis of the tool drum. This fixed gearwheel meshes with driving gearwheels, which are connected rotationally secured to the individual tool holders and convert the rotation of the tool drum into a derived rotation of the tool holders. It would also be possible as an alternative to provide each individual tool holder with a separate drive.

With the mining machine according to the present disclosure the tilt device may preferably comprise at least one, more particularly two lift cylinders, which is or are fastened by one cylinder end on a cylinder stop on the base part and by another cylinder end on a pivotal base. It is particularly advantageous if the pivotal base is mounted in turn pivotally on a slide carriage device, which is longitudinally displaceable relative to the machine base frame and which enables the cutting depth to be adjusted without moving the mining machine since the slide carriage device is adjusted by the desired cutting depth relative to the mining machine in each case until the slide carriage device has reached its front stop.

With the mining machine according to the present disclosure the pivotal device may also comprise preferably pivotal cylinders as the driving members. These can be mounted particularly expediently between the pivotal base and the slide carriage device, and, thus, cause in a relatively simple way a pivotal movement of the pivotal base about a pivotal axis running orthogonally to the slide carriage device. It may be particularly advantageous if the pivotal axis, a tilt axis of the cantilever unit and the longitudinal axis of the cantilever unit have a common intersection point. The mining machine can, however, also be designed so that the individual axes have no common intersection point, or only two of the axes have an intersection point.

In order to be able to reach a favourable pivotal movement of the pivotal base, it may be advantageous if the pivotal cylinders are fastened on the pivotal base on cylinder stops whose spacing is greater than the spacing of the fastening points of the pivotal cylinders on the slide carriage unit. The base part can be fastened for tilting movement on a tilting console, which is preferably fastened on the pivotal base. Through the tilting console it may be also possible to achieve an advantageous vertical spacing between the tilt axis and the bed of the tunnel even with a low drive chassis and a relatively large drum diameter of the tool drum. More advantageously the tilt axis hereby may have a vertical spacing, which is less than the effective diameter for the material excavation at the tool drum, which is determined by the working chisels each with the greatest radial distance from the drum axis. For excavating the lowermost surface track, the longitudinal axis of the cantilever unit can or must be angled downwards relative to the horizontal. For excavating a middle surface track, it can or must be angled slightly upwards in relation to a horizontal plane. For the uppermost surface track, it can or must be angled more steeply upwards accordingly. This may have the further advantage that in the middle and lowermost surface tracks, material is excavated approximately at the same distance from the tilt axis, whilst the uppermost surface track lies off-set back relative to the two other surface tracks.

For the excavating work with the individual tool chisels it may be in particular advantageous if the rotational axes of the tool holders are at an inclined angle or angle inclined to the normal to the drum axis. This incline angle to the normal, thus an angle of $90°+\alpha$, may be preferably selected so that the angle $\alpha$ itself lies between about 6° and 18° and more particularly amounts to about $15°\pm1°$.

Also with the method according to the present disclosure the material excavation takes place by means of excavating tools, which comprise rotatable tool holders with one support head each holding several tool chisels, wherein the rotational axes preferably each run inclined to the drum axis. For the method according to the present disclosure it is further envisaged that the cantilever unit has, between a front support arm part, on which the tool drum is mounted on one side, and a base part, a rotary mechanism for rotating the support arm part and the tool drum relative to the base part about a longitudinal axis of the cantilever unit, for this enables the method to be carried out according to the present disclosure such that during the material excavation at a work front after each pivotal process, the drum axis of the tool drum is turned via the rotary mechanism in the direction of movement of the cantilever unit, whereby, material can be excavated continuously with the excavating tools, namely even then when the cantilever unit is pivoted vertically by means of the tilt device. During rotation of the support arm part next to the drum axis of the tool drum by means of the rotary mechanism, the tilt device can thus be actuated in order during the tilt process to excavate material with the excavating tools and to undertake the following pivotal process without interrupting the excavation process above or below the previously excavated surface or surface track.

An adjusting movement can be carried out either via the drive chassis of the mining machine, before or whilst a middle surface track is excavated, or the mining machine may have according to an advantageous embodiment a longitudinally displaceable slide carriage unit on which the pivotal base is mounted, whereby an adjusting movement can also take place via the slide carriage unit before or whilst a middle surface track is excavated.

Although the preferred embodiments of this present disclosure have been described herein, improvements and modifications may be incorporated without departing from the scope of the following claims.

The invention claimed is:

1. A method for operating a mobile mining machine including a movable machine base frame; a tool drum configured to rotate about a drum axis and including excavating tools arranged around a periphery of the tool drum; a rotational drive configured to drive the tool drum; a cantilever unit including a base part and a front support arm part on which the tool drum is rotatably mounted, wherein the front support arm part is designed to be at least one of substantially L-shaped or hollow, and wherein a gear train is mounted in the front support arm part; a pivotal device configured to pivot the cantilever unit relative to the movable machine base frame about a pivotal axis; a tilt device configured to tilt the cantilever unit about a tilt axis; and a rotary mechanism mounted between the front support arm part and the base part and being configured to rotate the front support arm part and the tool drum relative to the base part about a longitudinal axis of the cantilever unit, wherein the rotary mechanism is configured to permit about 360° rotation of the front support arm part and the tool drum relative to the base part about the longitudinal axis of the cantilever unit, and wherein the tool drum is rotatably mounted on one side of the front support arm part, the method comprising:

Pivoting the cantilever unit of the mobile mining machine about the pivotal axis via the pivotal device of the mobile mining machine;

excavating material at a work face via the tool drum of the mobile mining machine while pivoting the cantilever unit in both pivotal directions; and rotating the drum axis of the tool drum via the rotary mechanism of the mobile mining machine during excavation of material at the work face, wherein material is continuously excavated with the excavating tools, wherein:

the tool drum is configured to rotate about the drum axis and including excavating tools arranged around the periphery of the tool drum, and the cantilever unit including the base part and the front support arm part on which the tool drum is rotatably mounted, wherein the front support arm part is designed to be at least one of substantially L-shaped or hollow, and wherein the gear train is mounted in the front support arm part.

2. The method according to claim 1, further comprising:

while rotating the front support arm part next to the drum axis of the tool drum via the rotary mechanism, actuating the tilt device to tilt the cantilever unit and to excavate the material with the excavating tools and to carry out pivoting the cantilever unit without interrupting the excavating process above or below surface which has previously been excavated.

3. The method according to claim 1, further comprising: carrying out a feed motion via a drive chassis of the mobile mining machine before or while a middle surface track is being excavated.

4. The method according to claim 1, further comprising: carrying out a feed motion via a slide carriage unit before or while a middle surface track is being excavated such that a pivotal base is mounted on the slide carriage unit which is longitudinally displaceable relative to the movable machine base frame.

* * * * *